US008456415B2

(12) United States Patent
Hollemans et al.

(10) Patent No.: US 8,456,415 B2
(45) Date of Patent: Jun. 4, 2013

(54) OBJECT, METHOD AND SYSTEM FOR TRANSMITTING INFORMATION TO A USER

(75) Inventors: Gerrit Hollemans, Eindhoven (NL); Vincentius P. Buil, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 361 days.

(21) Appl. No.: 12/811,389

(22) PCT Filed: Dec. 22, 2008

(86) PCT No.: PCT/IB2008/055487

§ 371 (c)(1), (2), (4) Date: Jul. 1, 2010

(87) PCT Pub. No.: WO2009/087528

PCT Pub. Date: Jul. 16, 2009

(65) Prior Publication Data

US 2010/0283728 A1 Nov. 11, 2010

(30) Foreign Application Priority Data

Jan. 4, 2008 (EP) ..... 08100086

(51) Int. Cl.
*G09G 5/00* (2006.01)
*G06F 3/041* (2006.01)

(52) U.S. Cl.
USPC ..... 345/156; 345/173; 463/9; 463/30; 273/237

(58) Field of Classification Search
None
See application file for complete search history.

(56) References Cited

U.S. PATENT DOCUMENTS

| | | | | |
|---|---|---|---|---|
| 4,237,449 | A | 12/1980 | Zibell | |
| 7,982,720 | B2 * | 7/2011 | Rosenberg et al. | 345/173 |
| 2006/0073891 | A1 | 4/2006 | Holt | |
| 2007/0117602 | A1 * | 5/2007 | Madigou et al. | 463/14 |

FOREIGN PATENT DOCUMENTS

| | | | |
|---|---|---|---|
| EP | 1145183 | B1 | 10/2001 |
| GB | 2344257 | A | 5/2000 |
| GB | 2345628 | | 7/2000 |
| WO | 9713563 | A1 | 4/1997 |
| WO | 0115059 | A2 | 3/2001 |
| WO | 2006082547 | A2 | 8/2006 |
| WO | 2006120633 | A2 | 11/2006 |

* cited by examiner

*Primary Examiner* — Andrew L Sniezek

(57) ABSTRACT

An object for transmitting information to a user includes an information detection device for detecting and receiving an information signal, a touch detector for transmitting a touch detection signal upon detection of the user touching the object, and an electronic switch for electronically coupling the information detection device to a tactile stimulation unit upon receipt of the touch detection signal such that information signal is transmitted from the information detection device to a part of the user touching the object via the tactile stimulation unit. In this way, the object is suitable for transmitting information only to the user touching the object, and this information is hidden from and not transmitted to other users.

15 Claims, 5 Drawing Sheets

OBJECT, METHOD AND SYSTEM FOR TRANSMITTING INFORMATION TO A USER

FIELD OF THE INVENTION

The invention relates to an object for transmitting information to a user. The invention further relates to a method and a system for transmitting information to a user via an object.

BACKGROUND OF THE INVENTION

EP 1145183 B1 describes a game board that detects on which part of the game board a playing piece is present and thereupon transmits information visually or audibly to users, such as for example information regarding the location of the playing piece. When an audible signal in combination with headphones is used, the information is sent to a user in a secret way thereby ensuring that this information is not received by the other users, thus adding a degree of freedom to the game. However, the use of headphones for providing information to a user in a secret way is cumbersome and isolates the users from each other.

SUMMARY OF THE INVENTION

It is an object of the invention to provide an alternative for providing information to a user in a secret way. The invention is defined by the independent claims. Advantageous embodiments are defined by the dependent claims.

This object is achieved by providing an object for transmitting information to a user, comprising an information detection device for detecting and receiving an information signal, a touch detector for transmitting a touch detection signal upon detection of the user touching the object, and an electronic switch for electronically coupling the information detection device to a tactile stimulation means upon receipt of the touch detection signal such that information comprised in the information signal is transmitted from the information detection device to a part of the user touching the object via the tactile stimulation means.

The object comprises an information detection device which is enabled to receive and detect an information signal that may comprise secret information meant to be received only by a specific user. The object further comprises a touch detector for detecting that the object is touched by a user. The touch detector is also suitable for transmitting a touch detection signal in case it has detected that the user touches the object. The touch detector transmits this touch detection signal to an electronic switch which then closes an electronic connection between the information detection device and the tactile stimulation means. In this way the information comprised in the information signal is transmitted to the tactile stimulation means only when the user touches the object. The tactile stimulation means provides for the transmission of the information to the part of the user that touches the object thereby enabling the user to sense or feel the information via tactile stimulation of the object. The users who do not touch the object, and thus also do not sense or feel the object, consequently do not receive the information comprised in the information signal from the object. Hence, the information is sent in a secret way only to the part of the user that touches the object. The tactile stimulation means can include anything that is sensed or felt only by the user who touches the object and that is not sensed or felt by any other user who does not touch the object, such as for example a vibration, change in temperature of the object or a minor electricity pulse. Obviously, the tactile stimulation means does not provide for tactile stimulation that can be sensed by the other users. The touch detector ensures that the tactile stimulation means are only activated when the user touches the object. Touching of the object can be done by any part of the body of the user that can sense the tactile stimulation means, such as for example a hand or a finger. Finger print recognition can be added to ensure that the information is transmitted to a specific user only.

In an embodiment of the object according to the invention the information detection device comprises a memory device for storing the information comprised in the information signal. This advantageously provides for an object in which the function of detecting and receiving the information signal is independent of the point in time that the user touches the object. The information signal can be sent at any time, because the information comprised in the information signal will be stored in the memory device, and the information is thus available from the moment it is stored in the memory device for transmittal to the user. The information comprised in the information signal is thus transmitted from the memory device to the part of the user touching the object via the tactile stimulation means.

In another embodiment of the object according to the invention the information detection device comprises a processor for processing the information comprised in the information signal. The processor advantageously provides for a means to process the information comprised in the information signal such that the appropriate information in the appropriate format is transmitted to the part of the user touching the object.

In an embodiment of the object according to the invention the information detection device comprises a photosensitive sensor. In this way the information signal can be a, for example time dependent, light signal that is detected and received by the photosensitive sensor of the information detection device. The photosensitive sensor may comprise, for example, light dependent resistors or a light-dependent diode. In another example, the photosensitive sensor comprises a CCD module for detecting detailed images.

In an embodiment of the object according to the invention the electronic switch is further suitable for activating the tactile stimulation means upon receipt of the touch detection signal. The tactile stimulation means only requires being active in case the user touches the object. This advantageously saves power, because by activating the tactile stimulation means only when a user touches the object, the tactile stimulation means is only powered in case it transmits the information to the user. Otherwise the tactile stimulation means is passive and the power of the tactile stimulation means can be switched off. Another advantage is that the user who touches the object may provide for a visual shield of the object such that the other users, who do not touch the object, are not able to see any visual effects of the active tactile stimulation means thereby keeping the information secret only for the user touching the object.

In an embodiment of the object according to the invention the tactile stimulation means comprises a vibration unit. Advantageously the user is in this way able to feel the vibration unit when the user touches the object thereby activating the vibration unit. In this way only the user will receive information via a vibration of the object generated by the vibration unit in the object, while any other user, who does not touch the object, does not receive this information. The vibration is an embodiment of the tactile stimulation means which provides for a simple and cheap solution of transmitting information in a secret way to the user touching the object, without any other user noticing it.

In a preferred embodiment of the object according to the invention a vibration pattern and/or a vibration intensity of the vibration unit represents the information of the information signal. The vibration pattern and/or the vibration intensity provide for a means for translating the information, which is received by the information detection device and transmitted to the vibration unit, to information that is captured and understood by the user touching the object. For example, a number of repetitions of a vibration may represent a specific number which is of interest for the game. In another example the vibration intensity may represent the distance from the object to a location of interest in the game.

In a preferred embodiment of the object according to the invention the object comprises at least two vibration units located in at least two separate sides of the object. In this way directional information can be sent to the user that touches the object, for example secret information about where interesting game resources can be found relative to the object in the game. For example, the side of object where the vibration unit vibrates indicates to the user who touches the object the direction where interesting resources can be found or the preferable direction for a next move of the object.

In an embodiment of the object according to the invention the object comprises a playing piece suitable for being placed on a board surface. This provides for a way of transmitting information secretly to one user or game player only via the playing piece, such as for example a pawn. Preferably the board surface comprises an interactive display surface.

In an embodiment of the object according to the invention the electronic switch comprises a transistor with a gate that is controlled by the touch detector. This is a low cost implementation for controlling the coupling between the information detection device and the tactile stimulation means by the touch detector. When a game player touches the pawn, the touch detector transmits the touch detection signal to the gate of the transistor thereby closing the electronic connection between the information detection device and the tactile stimulation means. This provides for the transmittance of the information from the information detection device to the tactile stimulation means thereby enabling the user to sense or feel the information via the tactile stimulation of the object.

This object is also achieved by a method for transmitting information to a user via an object, the method comprising the steps of detecting and receiving an information signal and, upon detecting that a user touches the object, transmitting information comprised in the information signal to the user via tactile stimulation of a part of the user touching the object.

In an embodiment of the method according to the invention, the information comprised in the information signal is transmitted to the user who touches the object via vibration of the object in a vibration pattern and/or with a vibration intensity that varies depending on the information comprised in the information signal.

The information comprised in the information signal may also be stored in a memory device after the step of detecting and receiving the information signal and before the step of transmitting the information to the user. In this way the information can be transmitted to the user via tactile stimulation at any time after the information is stored in the memory device. Additionally, the information may be processed in a processor before the step of transmitting the information to the user.

This object is also achieved by a system for transmitting information to a user via an object, the system comprising a display and at least one object, in which the object comprises a photosensitive sensor for detecting and receiving an information signal from a game console, a touch detector for transmitting a touch detection signal upon detection of the user touching the object, and an electronic switch for electronically coupling the photosensitive sensor to a tactile stimulation means upon receipt of the touch detection signal such that information comprised in the information signal is transmitted from the photosensitive sensor to a part of the user touching the object via the tactile stimulation means, and in which the display comprises a display surface for displaying a control image and for supporting the object, and a system processor for generating the control image on the display surface, wherein the control image on the display surface represents the information signal from the game console, which is, for example, a computer system.

In a preferred embodiment of the system according to the invention, the display further comprises object detection means for detecting a position of the object on the display surface, wherein the processor is arranged for generating the control image on the display surface, underneath a bottom surface of the object. When light from the control image impinges on the information detection device in the bottom surface of the object, the information comprised in the control image is detected and received by the information detection device. Detailed images can comprise much information and are therefore very useful for transmitting information to the user via the object using a single control image.

BRIEF DESCRIPTION OF THE DRAWINGS

These and other aspects of the invention will be further elucidated and described with reference to the drawings, in which.

The Figures are not drawn to scale. The figures are only schematic and diagrammatic representations, showing only parts of the apparatus that are relevant for the elucidation of the invention. In general, identical components are denoted by the same reference numerals in the Figures.

DETAILED DESCRIPTION OF EMBODIMENTS

Figure 1:
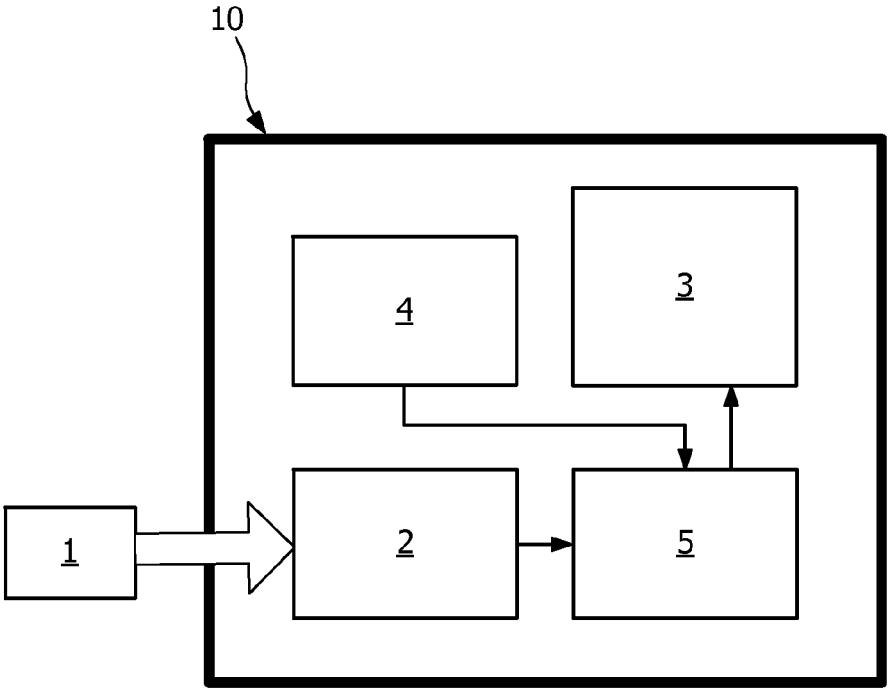
FIG. 1 is a schematic view of an embodiment of an object according to the invention.

FIG. 1 is a schematic view of an embodiment of an object 10 according to the invention. The object comprises an information detection device 2 for detecting and receiving an information signal 1. The information signal 1 may be transferred to the information detection device 2 by any means known in the art. For example, the information signal 1 is transmitted to the information detection device 2 wirelessly via, for example, RF signals, infra-red signals, light signals, electrical coupling, for example electrode contacts, or capacitive coupling. The object 10 further comprises a touch detector 4 for the detection of a user touching the object 10 and, upon such detection, transmitting a touch detection signal. For example, the touch detector 4 may comprises a capacitive touch sensor for the detection of the user touching the object 10. The object 10 further comprises an electronic switch 5 which provides for an electronic coupling between the information detection device and a tactile stimulation means 3 upon receipt of the touch detection signal from the touch detection device 4. Additionally, the touch detection signal may also trigger the receipt of the information signal 1 by the information detection device 2, which is not shown in FIG. 1.

Figure 2:
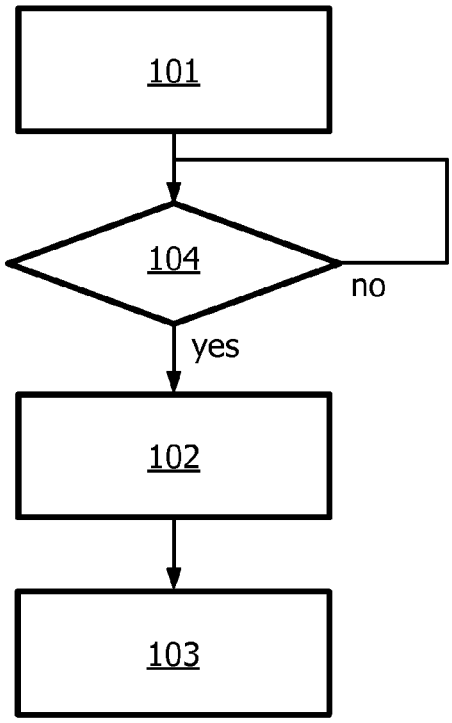
FIG. 2 illustrates the steps of an embodiment of a method for transmitting information to a user via an object according to the invention.

FIG. 2 illustrates a method for transmitting information from an object 10 to a user according to an embodiment of the invention. In the first step 101 the information signal 1 is transmitted to the object 10. In the second step 104 it is checked whether the object 10 is touched by the user. If the object 10 is not touched, then no action is taken. If the object 10 is touched by the user, the information signal 1 is received by the object 10 in the third step 102. Alternatively, the information signal 1 may be received by the object 10 before step 103. Thereafter, in step 103 the information signal 1 is transmitted to a part of the user that touches the object 10 via tactile stimulation.

Figure 3:
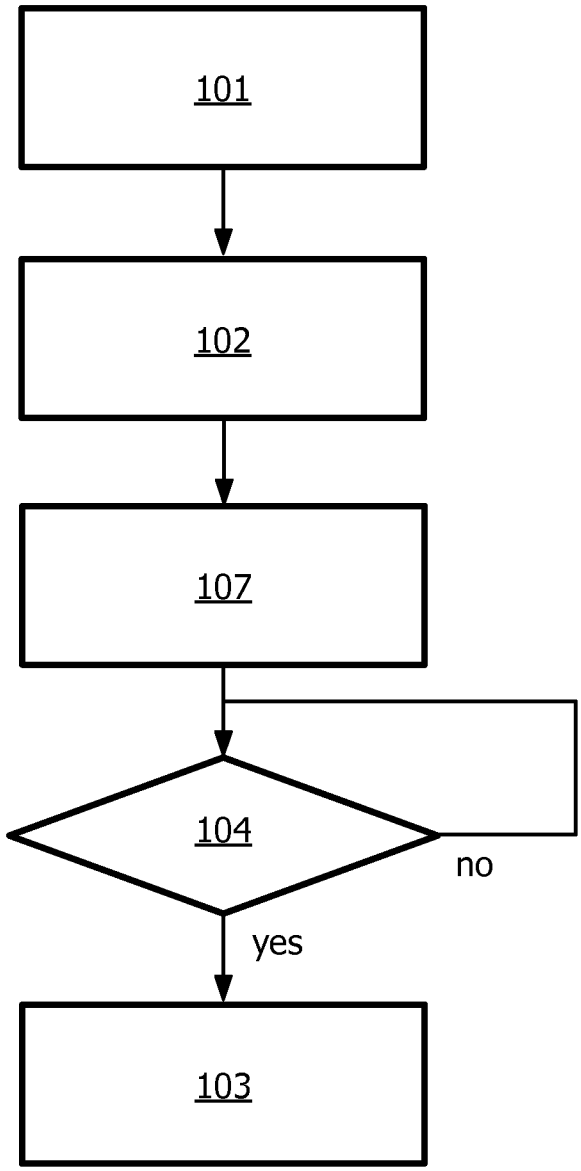
FIG. 3 illustrates the steps of another embodiment of a method for transmitting information to a user via an object according to the invention.

FIG. 3 illustrates a method for transmitting information from an object 10 to a user according to another embodiment of the invention. In the first step 101 the information signal 1 is transmitted to the object 10. In the second step 102 the information signal 1 is received by the object 10 and in the third step 107 the information signal 1 is stored in a memory device. In the next step 104 it is checked whether the object 10 is touched by the user. If the object 10 is not touched, then no action is taken. If the object 10 is touched by the user, then in step 103 the stored information signal 1 is transmitted to a part of the user that touches the object 10 via tactile stimulation. Because the information signal 1 is stored, steps 104 and 103 may be performed independently of steps 101, 102 and 107 except that step 103 can only be done when the information signal 1 is available and hence, in this example, stored in the memory device.

Figure 4:
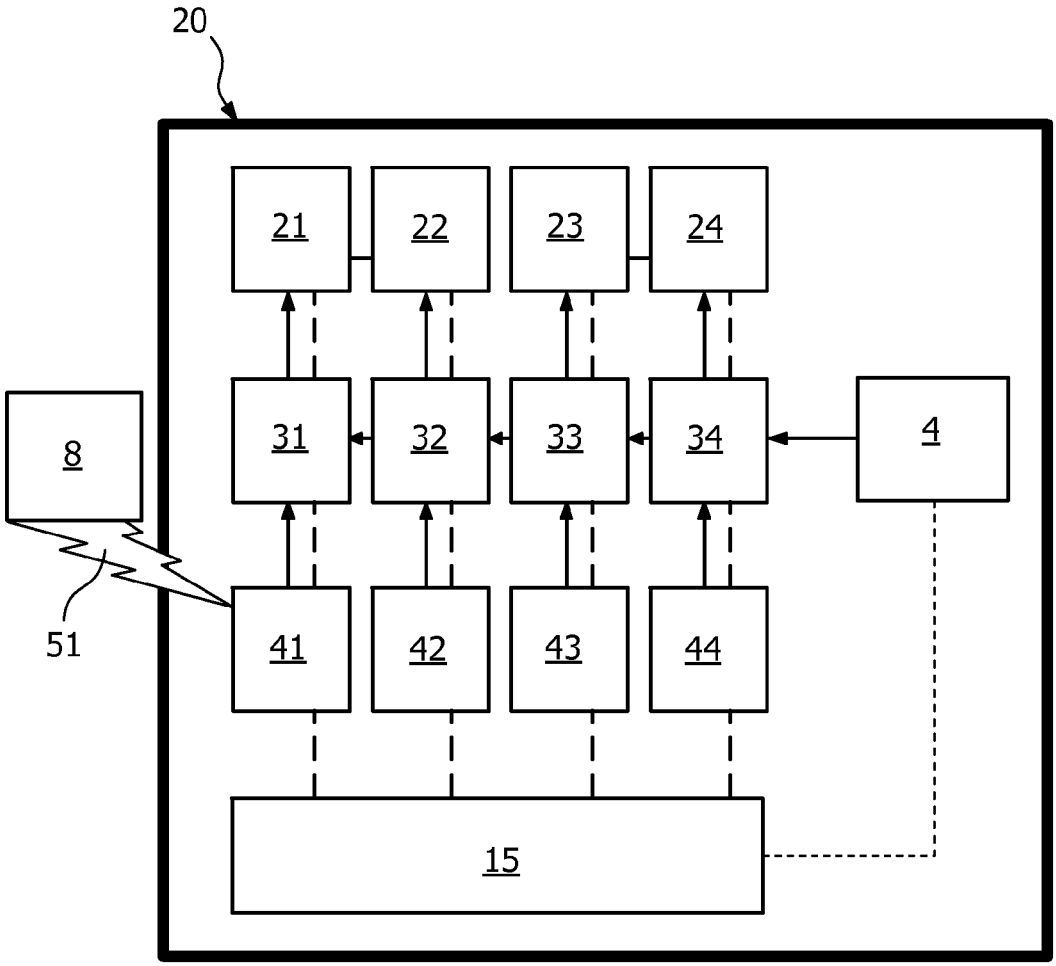
FIG. 4 is a schematic view of another embodiment of an object according to the invention.

FIG. 4 is a schematic view of another embodiment of an object 20 according to the invention. The object 20 comprises a power supply 15, such as for example a battery, for supplying power to several devices in the object 20. The object 20 comprises, in this example, four photosensitive sensors 41, 42, 43 and 44 for sensing and receiving a light signal 51 from a system controller 8. The light signal 51 may be transmitted to all of the four photosensitive sensors 41, 42, 43, 44 simultaneously and the information comprised in the light signal 51 may be encoded in the time domain, for example by transmitting light in pulses of varying duration. Alternatively, each photosensitive sensor 41, 42, 43 and 44 may receive a light signal 51 independently, which is not shown in the Figure, in which the information is encoded in the spatial domain. The spatial and the time dependent light signal 51 may also be combined. The object 20 further comprises the touch detection device 4 for detecting if the user touches the object 20 and thereupon transmitting the touch detection signal to a, in this example, common gate of four transistors 31, 32, 33 and 34. When activated by the touch detection signal, the four transistors 31, 32, 33, 34 provide for an electronic coupling between the photosensitive sensors 41, 42, 43, 44 and four vibration units 21, 22, 23 and 24. In this way the information signal is transmitted to the vibration units 21, 22, 23, 24 that will vibrate dependent on the information signal 51. This vibration is then sensed by a part of the user that touches the object 20, for example the finger or hand of a human being. Each of the vibration units 21, 22, 23, 24 may vibrate independent of the other. In this way, for example, when the vibration units 21, 22, 23, 24 are located in different parts of the object 20, directional information may be transmitted to the user touching the object 20. For example, if only vibration unit 21 vibrates, then the information for the user is a direction extending from the location of the vibration unit 21 in the object 20.

A processor, which is not shown in this Figure, may be added to translate or encode the information signal 51 into a vibration pattern that corresponds to the information comprised in the information signal 51 and that is comprehensible for the user touching the object 20.

The vibration pattern may be time dependent, for example by vibrating with pulses of varying duration. The vibration pattern may also, or alternatively, comprise vibrations with a varying intensity. The power supply 15 provides for the power required for the vibration of the vibration units 21, 22, 23, 24.

Figure 5:
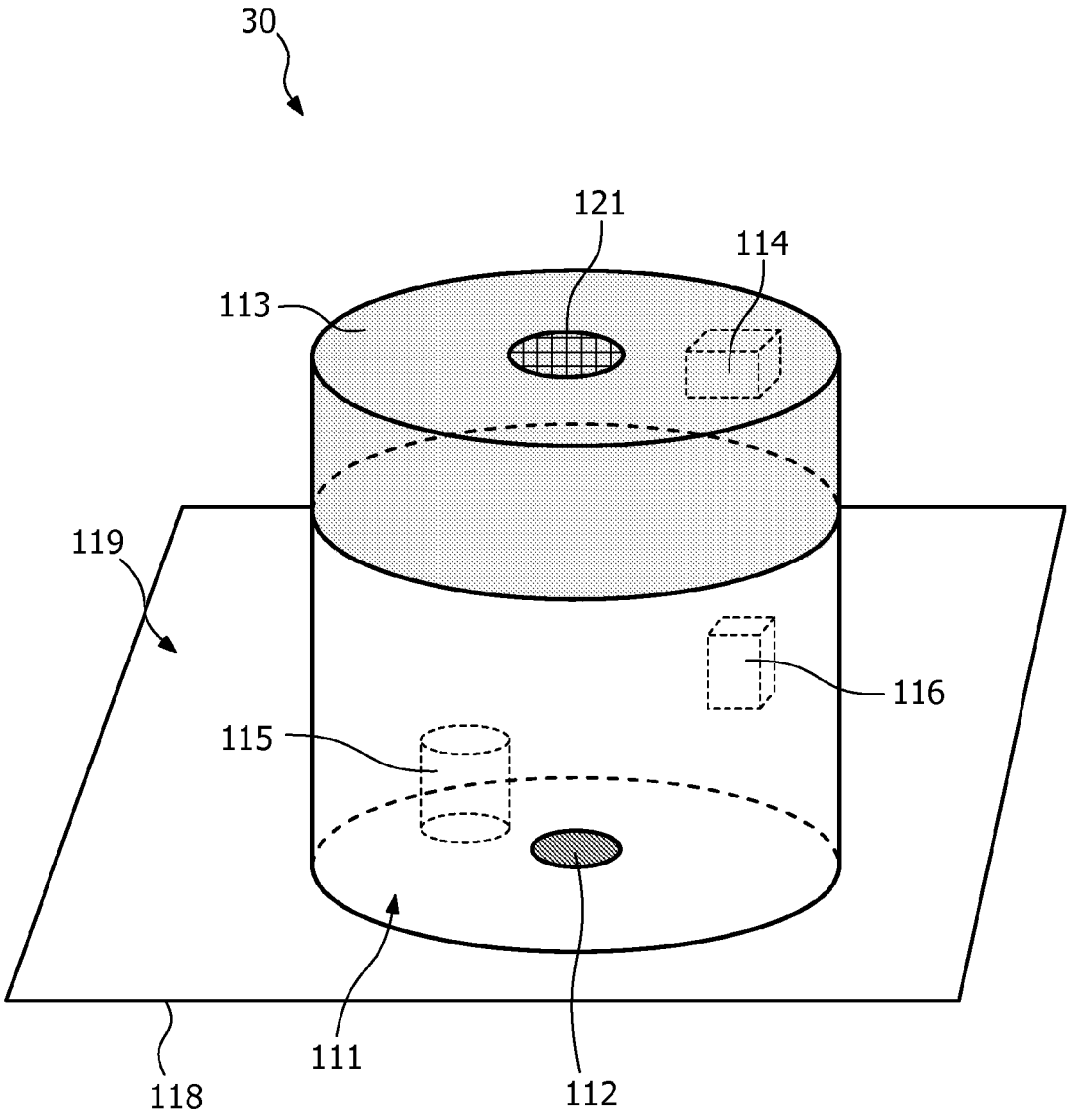
FIGS. 5 and 6 are schematic perspective views of embodiments of an object according to the invention.

FIG. 5 shows a schematic perspective view of an embodiment of a system with an object 30 according to the invention. The object 30 in this embodiment is a playing piece, such as for example a pawn, for use in a game played by more than one user. A bottom surface 111 of the object 30 rests on the display surface 119 of the display 118, which is for example an interactive game board. The bottom surface 111 of the object 30 comprises a photosensitive sensor 112, such that it can receive light from the display surface 119. The photosensitive sensor 112 comprises for example a light dependent resistor, a photovoltaic cell, or a CCD sensor chip. The object 30 further comprises a touch sensitive area 113 which is controlled by a touch sensor 114. The touch sensor 114 is arranged to detect that a person, in this case a user, touches the touch sensitive area 113 and comprises, for example, a capacitive touch sensor. The side surface of the object 30 comprises a vibration unit 121. Furthermore, a power supply 115, for example a battery, and an electronic switch 116 are comprised in the object 30.

Information, for example on game resources or a next move or a hint on tactics to be applied, is transmitted in the form of a light signal, for example with a varying light intensity, or a light pattern from the display 119 of the display 118 to the bottom surface 111 of the object 30. The light pattern or signal is detected and received by the photosensitive sensor 112 in the bottom surface 111 of the object 30. When a user touches the object 30, this is detected by the touch detector 114 which transmits a touch detection signal to an electronic switch 116 whereupon the electronic switch 116 electrically connects the photosensitive sensor 112 with the vibration unit 121 such that the information comprised in the light pattern or signal is transmitted to the vibration unit 121. The vibration unit 121 vibrates in response to the information signal thereby providing the user who touches the object 30 with the information transmitted by the display 118. This user is the only person in the game that can feel and sense the vibration signals, providing only this user with this information. In this way information is transmitted in a hidden and secret way to that user only.

The object 30 may also comprise a memory device, not shown in the Figure, for advantageously storing the information comprised in the information signal. The memory device then transmits the information to the vibration unit 121 upon detection of the user touching the object 30. Also a processor, not shown in the Figure, may advantageously be used to translate the information comprised in the information signal to a signal that is suitable for the vibration unit 114.

In an embodiment the intensity of the vibrations of the vibration unit 121 gives an indication on the distance from the object 30 to a location of interest on the game board 18. In another embodiment different vibration patterns, such as number of pulses, indicate that different resources are to be found at a location on the display surface 119 of the display 118. The vibration intensity and the vibration pattern may also be combined to indicate the direction of an interesting location and the game resources that can be found at this location.

In another embodiment the information communicated to the user via the object 30 is non-directional, for example a name of an entity in the game. This is achieved by presenting a list or a set of different names to the user or also to other users. The vibration unit 121 vibrates a number of times, wherein this number of vibrations is equal to the sequence number in the list of names presented to the users. In this way only the user who touches the object 30 knows what the name of the entity in the game is.

In an embodiment, the game transmits the information via a control image in the display 118 to the bottom surface 111 of the object 30. The control image is, for example, provided by a light in the display surface 119 of the display 18 which is detected and received by the photosensitive sensors 112. The information may be represented by the color of the control image, for example white or dark, or by the frequency of the color change in the control image. The display 118 may, for example, be an LCD display.

All electronics in the object 30 are powered by a battery. Alternatively, photovoltaic cells may be used for supplying power to the electronics in the object 30. The photovoltaic cells may directly power the electronics or may charge a battery. The photovoltaic cells may also be used for detecting the control images.

Figure 6:
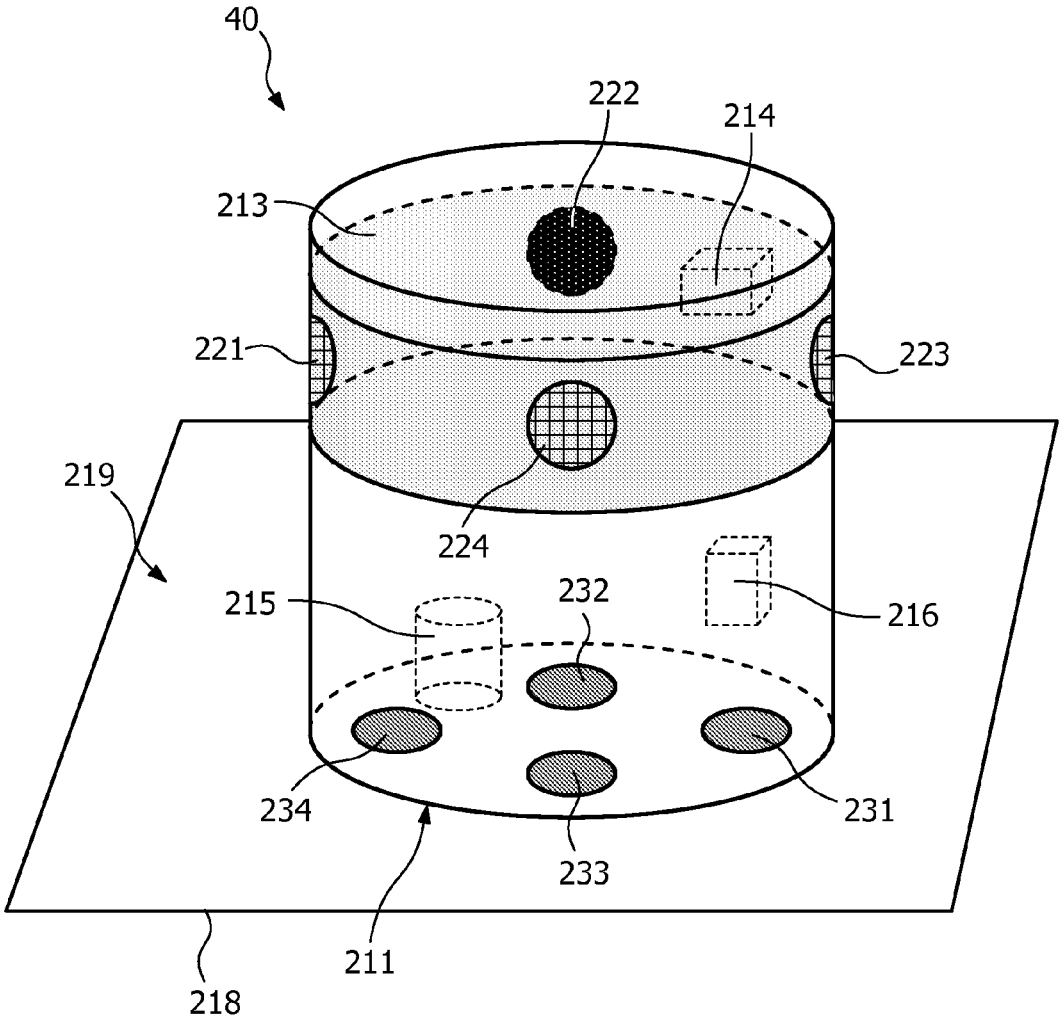

FIG. 6 shows an embodiment of an object 40 according to the invention. A bottom surface 211 of the object 40 rests on the display surface 219 of the display 218. The bottom surface 211 comprises, in this example, four photosensitive sensors 231, 232, 233, 234 such that these can receive light from the display surface 219. The photosensitive sensors 231, 232, 233, 234 comprise for example a light dependent resistor, a photovoltaic cell, or a CCD sensor chip. The object 40 further comprises a touch sensitive area 213 which is controlled by a touch sensor 214. The touch sensor 214 is arranged to detect that a person, in this case a user, touches the touch sensitive area 213. The side surface of the object 40 comprises, in this example, four vibration units 221, 222, 223, 224. Furthermore, a power supply 215, for example a battery, and an electronic switch 216 are comprised in the object 40.

Information, for example on game resources or a next move or a hint on tactics to be applied, is transmitted in the form of a light signal or pattern from the display 219 of the game board 218 to the bottom surface 211 of the object 40. The light pattern or signal is detected and received by the photosensitive sensors 231, 232, 233, 234 in the bottom surface 211 of the object 40. When a user touches the object 40, this is detected by the touch detector 214 which transmits a touch detection signal to the electronic switch 216 whereupon the electronic switch 216 electrically connects the photosensitive sensors 231, 232, 233, 234 with the vibration units 221, 222, 223, 224 such that the information comprised in the light pattern or signal is transmitted to the vibration units 221, 222, 223, 224. The vibration units 221, 222, 223, 224 vibrate in response to the information signal thereby providing the user who touches the object 40 with the information transmitted by the game board 218.

The information can, for example, be directional information. If one of the vibration units 221, 222, 223 or 224 vibrates, the user gets a hint on a direction, which is the direction at the side where the vibrating vibration unit 221, 222, 223 or 224 is located. It is also possible that two adjacent vibration units 221, 222, 223, 224 vibrate, thereby indicating a direction in between these two vibrating vibration units 221, 222, 223, 224. The directional information may, for example, comprise information as regards the preferred next move of the object 40, or the direction where the user may found additional information that is interesting for the game tactics. For example, if the respective vibration units 221, 222, 223, 224 that are located on a north side and an east side of the object 40 vibrate when the user touches the object 40, the user knows that there is something interesting to be found north-east of the object 40. In this way the game can give secret hints to one user. A vibration intensity and a vibration pattern may also be combined to indicate the direction of an interesting location and the game resources that can be found at this location.

In another embodiment secret information is transmitted from the user to the game. For example, the user wants to secretly place a bid in the game, via selecting a single option, which is the bidding value, from a list of bidding values shown on the display 219. The vibration units 221, 222, 223, 224 now represent a sequence number, in this case one, tow, three and four, respectively. For example, in case vibration unit 223 vibrates, then the user touching the object 40 knows that the sequence number is three. The user now selects all bidding values presented in the list in a sequence chosen by the user himself. The game and the user only know that, in this example, the third option that the user selects represents the bidding value that the user has really selected and only the third selection is input for the game console and used as the actual bid. In this way the other users do not know what the bid was that was placed by this user. They only have a chance of 25% to guess the right bidding value. This chance of guessing the right input value can be increased or decreased by varying the number of vibration units 221, 222, 223, 224, where the minimum configuration comprises two vibration units wherein the chance that the other users guess the bidding value entered into the game is in that case 50%. Alternatively, one vibration unit 221, 222, 223 or 224 may be applied wherein the number of vibration pulses represents a specific sequence number.

In another method, the user enters several, decoy, bidding values and, when the user senses a vibration signal, he has to enter the real bidding value. After that the user may continue with entering more, decoy, bidding values.

Apart from entering numerical bids, also other information can be entered this way, such as multiple-choice answers, north-east-south-west directions to help other users, resources or other items the user wants to offer for trade. Also, multiple secret information entries can be done in sequence if desired, for example first an identification of a second user to whom the user touching the object 40 would like to transmit secret information, and then the secret information itself, such as for example the directional information where the second user can find a resource of which the user touching the object 40 knows the location of. This can be done with a single sequence number or with a separate sequence number for each element of information that needs to be entered.

In an embodiment, the game transmits the information via a control image in the display 218 to the bottom surface 211 of the object 40. The control image is, for example, provided by a light in the display surface 219 of the display 218 which is detected and received by the photosensitive sensors 231, 232, 233, 234. The information may be represented by the color of the control image, for example white or dark, or by the frequency of the color change in the control image. In an alternative embodiment the object 40 comprises an array of photosensitive sensors for detecting more detailed control images. An example of such an array is a CCD module as is often used in digital photo cameras. When using such an array, the control image may, for example, comprise bar codes, text, arrows or other symbols.

In an embodiment of a system according to the invention, the system comprises the display 118, 218 and a plurality of objects 30, 40 as described above. The objects 30, 40 are placed on the display surface 119, 219 of the display 118, 219. The display comprises a graphics unit for displaying graphics on the display surface 119, 219. An object detection unit detects the positions of the objects 30, 40 on the display surface 119, 219. Many techniques are known in the art for detecting the position of an object on a board. A processor uses the information about the positions of the objects 30, 40 and calculates where on the display surface 119, 219 a control image has to be displayed. The graphics unit then generates the control image. When the control image is used for controlling movements of the object 30, 40, the object detection unit may continuously provide the position of the object 30, 40 to the processor for recalculating the position where the control image should be displayed.

In an alternative embodiment, the display 118, 218 does not comprise the object detection unit. The user is instructed to place the object 30, 40 on a particular position on the display surface 119, 219, where a control image is displayed. This position on the display surface 119, 219 is not continuously obscured by an object 30, 40. Therefore the control image preferably emits light at non visible wavelengths, such as infrared or ultraviolet light.

For example, a mobile phone, when used in a silent mode in which it does not produce an audible sound but only a vibration, may comprise such an object according to the invention in which the information transmitted to the user is comprised in the vibration of the mobile phone in addition to, or next to, the information on a visual display of the mobile phone. Only when the user touches the mobile phone, it will vibrate, and the user then receives information via the vibration of the mobile phone, for example that an SMS has been received from a specific person. In another example, a computer peripheral, such as a mouse or a joystick may comprise such an object according to the invention.

In summary, the invention relates to an object for transmitting information to a user, wherein the object comprises an information detection device for detecting and receiving an information signal, a touch detector for transmitting a touch detection signal upon detection of the user touching the object, and an electronic switch for electronically coupling the information detection device to a tactile stimulation means upon receipt of the touch detection signal such that information comprised in the information signal is transmitted from the information detection device to a part of the user touching the object via the tactile stimulation means. In this way the object is suitable for transmitting information only to the user touching the object, and this information is hidden from and not transmitted to other users.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements.

The invention claimed is:

1. An object for transmitting information to a user, comprising:

an information detection device for detecting and receiving an information signal from a display surface that supports the object;

a touch detector for transmitting a touch detection signal upon detection of the user touching the object; and an electronic switch for electronically coupling the information detection device to a tactile stimulator upon receipt of the touch detection signal such that information comprised in the information signal is transmitted from the information detection device to a part of the user touching the object via the tactile stimulator.

2. The object as claimed in claim 1, wherein the information detection device comprises a memory device for storing the information comprised in the information signal.

3. The object as claimed in claim 1, wherein the information detection device comprises a processor for processing the information comprised in the information signal.

4. The object as claimed in claim 1, wherein the information detection device comprises a photosensitive sensor.

5. The object as claimed in claim 1, wherein the electronic switch is further suitable for activating the tactile stimulator upon receipt of the touch detection signal.

6. The object as claimed in claim 1, wherein the tactile stimulator comprises a vibration unit.

7. The object as claimed in claim 6, wherein a vibration pattern and/or a vibration intensity of the vibration unit represents the information of the information signal.

8. The object as claimed in claim 6, wherein the object comprises at least two vibration units located in at least two separate sides of the object.

9. The object as claimed in claim 1, wherein the object comprises a playing piece suitable for being placed on a board surface.

10. The object as claimed in claim 9, wherein the board surface comprises the display surface.

11. The object as claimed in claim 1, wherein the electronic switch comprises a transistor with a gate that is controlled by the touch detector.

12. A method for transmitting information to a user via an object, comprising the acts of:

detecting and receiving an information signal from a display surface that supports the object; and upon detecting that a user touches the object, transmitting information comprised in the information signal to the user via tactile stimulation of a part of the user touching the object.

13. The method as claimed in claim 12, wherein the information comprised in the information signal is transmitted to the user who touches the object via vibration of the object in a vibration patter and/or with a vibration intensity that varies depending on the information comprised in the information signal.

14. A system for transmitting information to a user via an object, the system comprising a display and at least one object, in which the object comprises:

a photosensitive sensor for detecting and receiving an information signal from a game console, a touch detector for transmitting a touch detection signal upon detection of the user touching the object, and an electronic switch for electronically coupling the photosensitive sensor to a tactile stimulation means upon receipt of the touch detection signal such that information comprised in the information signal is transmitted from the photosensitive sensor to a part of the user touching the object via the tactile stimulation means:

and in which the display comprises:

a display surface for displaying a control image and for supporting the object, and a system processor for generating the control image on the display surface, wherein the control image on the display surface represents the information signal from the game console.

15. The system as claimed in claim 14, wherein the display further comprises object detection means for detecting a position of the object on the display surface and wherein the system processor is arranged for generating the control image on the display surface, underneath a bottom surface of the object.

* * * * *